US005476143A

United States Patent [19]

Sparlin et al.

[11] Patent Number: 5,476,143

[45] Date of Patent: Dec. 19, 1995

[54] WELL SCREEN HAVING SLURRY FLOW PATHS

[75] Inventors: Derry D. Sparlin, Spring, Tex.; Tadayoshi Nagaoka, Osaka, Japan; Jeff Ashton, Conroe, Tex.

[73] Assignee: Nagaoka International Corporation, Osaka, Japan

[21] Appl. No.: 236,621

[22] Filed: Apr. 28, 1994

[51] Int. Cl.[6] ..... E21B 43/08

[52] U.S. Cl. ..... 166/233; 166/234

[58] Field of Search ..... 166/227, 231, 166/233, 234, 236; 29/163.7; 209/273; 210/497.1, 497.01; 228/904

[56] References Cited

U.S. PATENT DOCUMENTS

| | | | |
|---|---|---|---|
| 2,046,459 | 7/1936 | Johnson | 166/233 |
| 2,310,507 | 2/1943 | Bodey | 166/231 |
| 2,323,992 | 7/1943 | Hardeman | 166/227 |
| 4,068,713 | 1/1978 | McGuire | 166/233 |
| 4,167,972 | 9/1979 | Sears | 166/233 |
| 4,378,294 | 3/1983 | Wagner et al. | 166/231 X |
| 4,494,603 | 1/1985 | Harguindey | 166/231 |
| 4,770,336 | 9/1988 | Arterbury et al. | 166/235 X |
| 4,771,829 | 9/1988 | Sparlin | 166/233 |
| 4,945,991 | 8/1990 | Jones | 166/278 |
| 5,004,049 | 4/1991 | Arterbury | 166/233 X |
| 5,311,942 | 5/1994 | Nagaoka | 166/233 X |

*Primary Examiner*—Roger J. Schoeppel

*Attorney, Agent, or Firm*—Bernard A. Reiter; Mark L. Berrier

[57] ABSTRACT

A well screen having slurry flow paths enclosed therein includes support rods extending in the axial direction of the screen disposed cylindrically at a predetermined interval in the circumferential direction of the screen, a wire wound on the outer periphery of said support rods so as to form slits of a predetermined width, one or more flow paths for gravel-containing slurry provided inside of the wire and extending in the axial direction of the screen, and openings for communicating the flow paths with the outside of the screen. Lowering and lifting of the screen through a wellbore can be made smoothly without interfering of the slurry flow paths with the wellbore and installation of the screen can thereby be facilitated.

17 Claims, 19 Drawing Sheets

WELL SCREEN HAVING SLURRY FLOW PATHS

BACKGROUND OF THE INVENTION

This invention relates generally to the field of oil well, gas well, water well and subterranean pollution remediation well equipment and, more particularly, to a device which facilitates installation of a filtering medium filtering sand and undesirable solids from fluids, gases, and toxic extraction from subterranean well bores.

Many types of screens and filtering devices are known in the art that are designed to exclude sand and other solids from fluids and gases produced from oil gas, water and pollution remediation wells without undue restriction of the production rate of fluids or gases. These devices are often used with filter aids, such as gravel and/or sand, which are either incorporated within the device or separately placed surrounding the device.

Wire wrapped screens and prepacked screens are examples of devices used inside a drilled hole. The drilled hole may be left open or may have a casing or liner cemented and perforated prior to positioning such a device. Openings in such screens may be designed to stop, or bridge undesirable solids contained in fluids or gases.

Screens and well liners are often surrounded by filter aids. The filter aids consist commonly of gravel. When used with filter aids or gravel, the openings in the screen and liners are designed to stop, or bridge, the filter aid and the filter aid is designed to stop or bridge the undesirable solids contained in the produced fluids or gases.

Prepacked screens, porous material filter devices and such are examples of devices that incorporate a filter medial in the screen body. These devices are used for the same purpose and these filter aids commonly consist of gravel.

Multiple wrapped screens provide two or more concentric wire wrappings which act as multiple filters in one device to prevent invention of undesirable solids and are often used with filter aids, such as gravel, in the well bore.

One problem that all of these prior art devices have in common is that they have no practical means for packing gravel in voids or unpacked areas of outside gravel which s produced in the screen/wellbore annulus. Such voids or unpacked areas constitute a path for undesirable sand or solids entering from the unsolidified layer to the wellbore which results in corrosion of the screen, closure of the screen opening and/or filling the inside of the wellbore with undesirable sand or solids.

Such voids or unpacked areas are produced by flowing into the inside of the screen of conveying fluid which conveys gravel through the screen/wellbore annulus when the gravel is pumped through these voids.

This causes the velocity of the conveying fluid in the space and thereby causes concentration of gravel which is generally called gravel slurry dehydration and this prevents distribution of gravel over the entire length of the screen.

This problem is particularly serious in a high angle wellbore which is inclined by 45 degrees to 90 degrees from normal, as gravity forces the gravel in the low side of the wellbore to form dunes and these dunes prevent subsequent movement of the gravel in the screen/wellbore annulus. As the gravel is heaped up, the conveying fluid flows into the screen mainly from the high side of the screen which reduces the velocity the conveying fluid and thereby reduces the capacity of the fluid to push the gravel to the bottom or lower end of the screen.

In a very long (100–2,000 feet or over) and high angle degrees to 90 degrees), the gravel is heaped up on the low side of the wellbore when the gravel is pumped and, when feeding of the gravel is completed, the upper side of the screen is left uncovered by the gravel, so that it is particularly difficult to pack gravel in such a long wellbore. Subsequently, the portion of the screen which is not covered by the gravel is exposed to corrosion by solids contained in the produced fluid or gas and the opening of the screen is easily blocked by undesirable solids.

Dehydration of gravel slurry must be controlled so that sufficient dehydration will be achieved to prevent excessive loss of the fluid in the ground or screen and pack the gravel to the degree that each grain of the gravel is in contact with another.

U.S. Pat. No. 4,945,991, Jones, L. G., "Methods for Gravel Packing Wells" discloses a screen with substantially rectangular perforated shunt tubes attached to the outside of a screen longitudinally over the entire length of the screen, and connected between all sectional lengths of screens attached together to provide flow paths for the gravel laden fluid to flow into and pack voids or unpacked areas of the screen/wellbore annulus. This device allows the gravel/fluid slurry to enter-and flow through multiple flow paths near or above the screen and to thereafter flow both down the screen/wellbore annulus or down one or more of the appendaged perforated shunt tubes. Dehydration of the slurry in the perforated shunt tubes is inhibited by combination of limited area of perforations in the tubes and by the flow of gravel slurry down the screen/wellbore annulus, thus gravel slurry in the perforated shunt tubes is much less likely to be dehydrated and is most likely to flow continuously through the shunt tubes until it reaches the vicinity of a portion of the screen/wellbore annulus that is void of gravel or is not fully packed with gravel, then the gravel slurry in the perforated shunt tubes will flow into the inadequately gravel packed annulus.

Problems with the device of U.S. Pat. No. 4,945,991 are that it is troublesome to hang down the device into wellbore, that this device prevents a desirable flow of gravel slurry in the screen/wellbore annulus and that it is difficult to lift up this device from the wellbore when the device stuck to the wellbore and/or it becomes necessary to lift the device. Besides, it is extremely difficult to connect respective shunt tubes attached to the outside of the screen to shunt tubes attached to the outside of a following screen in the course of assembling the screen and lowering it into the wellbore.

It is therefore, a first object of the invention to provide an improved well screen having a plurality of gravel slurry flow paths which is easy to assemble at a well site, is easy to hang down or up through a wellbore and does not prevent gravel slurry flow in a screen/wellbore annulus.

It is a second object of the invention to provide a well screen facilitating connection of shunt tubes of one screen with shunt tubes of an adjacent screen while the screen is assembled and lowered in a well bore.

SUMMARY OF THE INVENTION

For achieving the first object of the invention, a well screen having a slurry flow path enclosed therein comprises a plurality of support members extending in the axial direction of the screen disposed cylindrically at a predetermined interval in the circumferential direction of the screen, wire means wound on the outer periphery of said support members as to form slits of a predetermined width, one or more flow paths for gravel-containing slurry provided inside of said wire means and extending in the axial direction of the screen, and a plurality of openings for communicating said flow paths with the outside of the screen.

According to the invention, flow paths for gravel-containing slurry are provided inside of the wire means and openings for communicating the flow paths with the outside of the screen are provided and no structure projecting outside of the screen such as shunt tubes is provided and, therefore, there is no danger of the screen sticking to the wellbore when the screen is lowered or lifted through the wellbore that lowering and lifting of the screen can be achieved as easily as any conventional well screen. Further, since there is no danger of preventing flow of gravel slurry in the screen/wellbore annulus by shunt tubes, a constantly smooth flow of gravel slurry can be expected.

In one aspect of the invention, a well screen having a slurry flow path enclosed therein comprises a generally cylindrical base member having perforations, a plurality of support members disposed on the outer periphery of said base member in the circumferential direction at a predetermined interval and extending in the longitudinal direction of the base member, wire means wound on the outer periphery of said support members so as to provide slits of a predetermined width, annulus defined by the inner side of said wire means, the outer periphery of said base member and two adjacent ones of said supporting members being provided in the circumferential direction of the base member, seal means provided at a selected position and interval in the axial direction of the screen for isolating and sealing said annulus, one or more flow paths for slurry provided between the inner periphery of said wire means and the outer periphery of said base member and extending in the axial direction of the screen, and openings provided in said seal means for communicating said flow paths with the outside of the screen.

According to this aspect of the invention, flow paths for gravel slurry are formed between the inner periphery of the wire means and the outer periphery of the base member and openings for communicating the flow paths with the outside of the screen are provided in the seal means. This arrangement obviates the necessity for drilling the openings through the wire wound portions of the screen with resulting prevention of reduction in the strength of the wire screen.

For achieving the second object of the invention, a well screen having the structure for achieving the first object of the invention further comprises a pipe having perforations formed at a predetermined interval and wherein said support members are disposed on the outer periphery of said pipe, said pipe is connected with said pipe of an adjacent well screen which is of the same construction as said screen in such a manner that the outer surfaces of the two adjacent pipes become flush with each other, a cylindrical cover plate is provided between the end portions of the two adjacent screens and the space between the inner periphery of said cover plate and the outer periphery of said pipes functions as a space for communicating the flow paths for slurry of the two screens with each other.

According to the invention, since two screens having perforated pipes are connected together in such a manner that the outer surfaces of the two pipes become flush with each other and a cylindrical cover plate is provided between the end portions of the two screens and the space between the inner periphery of the cover plate and the outer periphery of the pipes functions as a space for communicating the flow paths for slurry of the two screens with each other, the flow paths of the two screens need not be connected directly with each other and this facilitates connection of the flow paths for gravel slurry at a site of installing the screen.

Embodiments of the invention will be described below with reference to the accompanying drawings.

DESCRIPTION OF PREFERRED EMBODIMENTS

Figure 1:
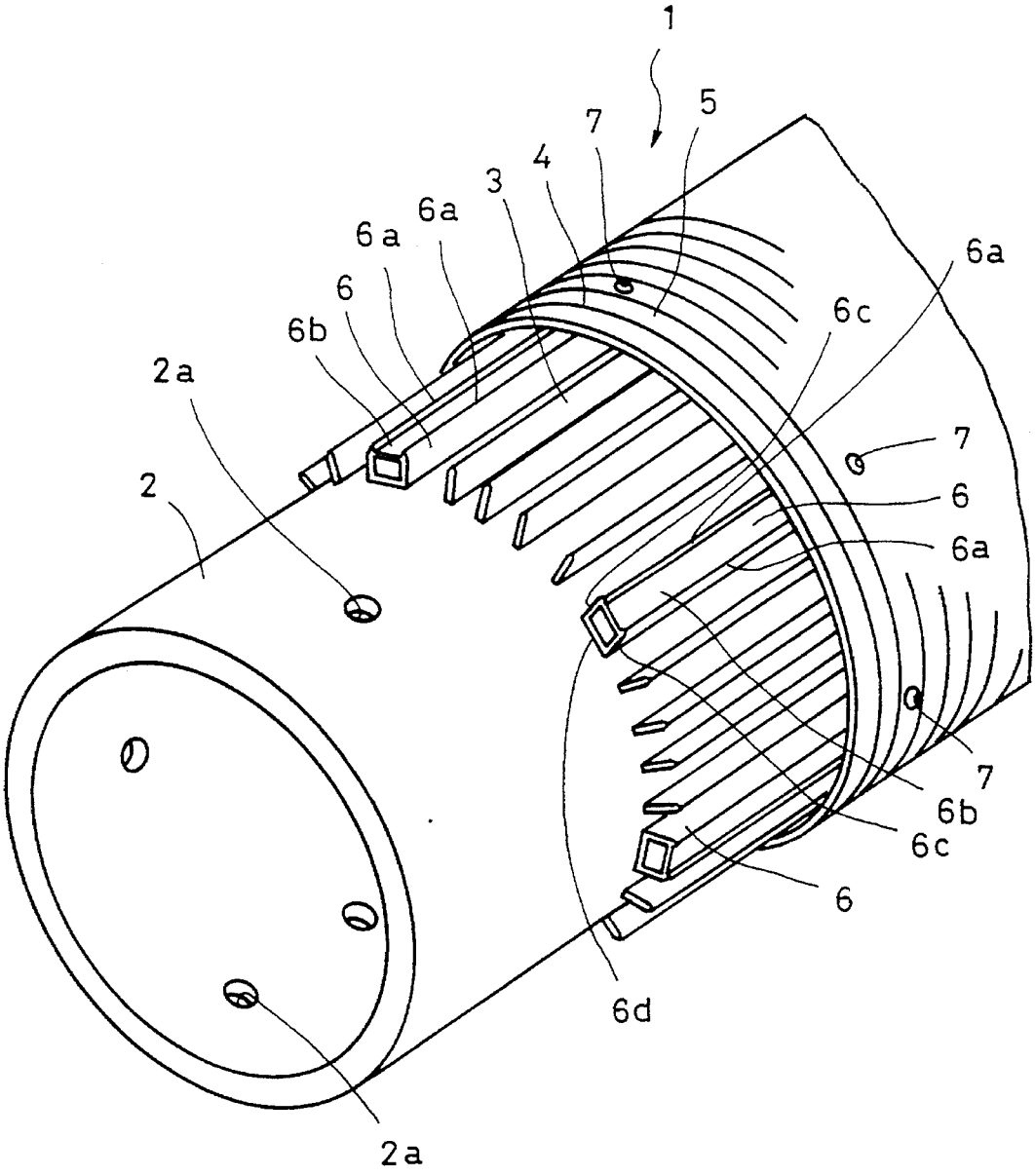
FIG. 1 is a perspective view of an embodiment of screen made according to the invention.
Figure 2:
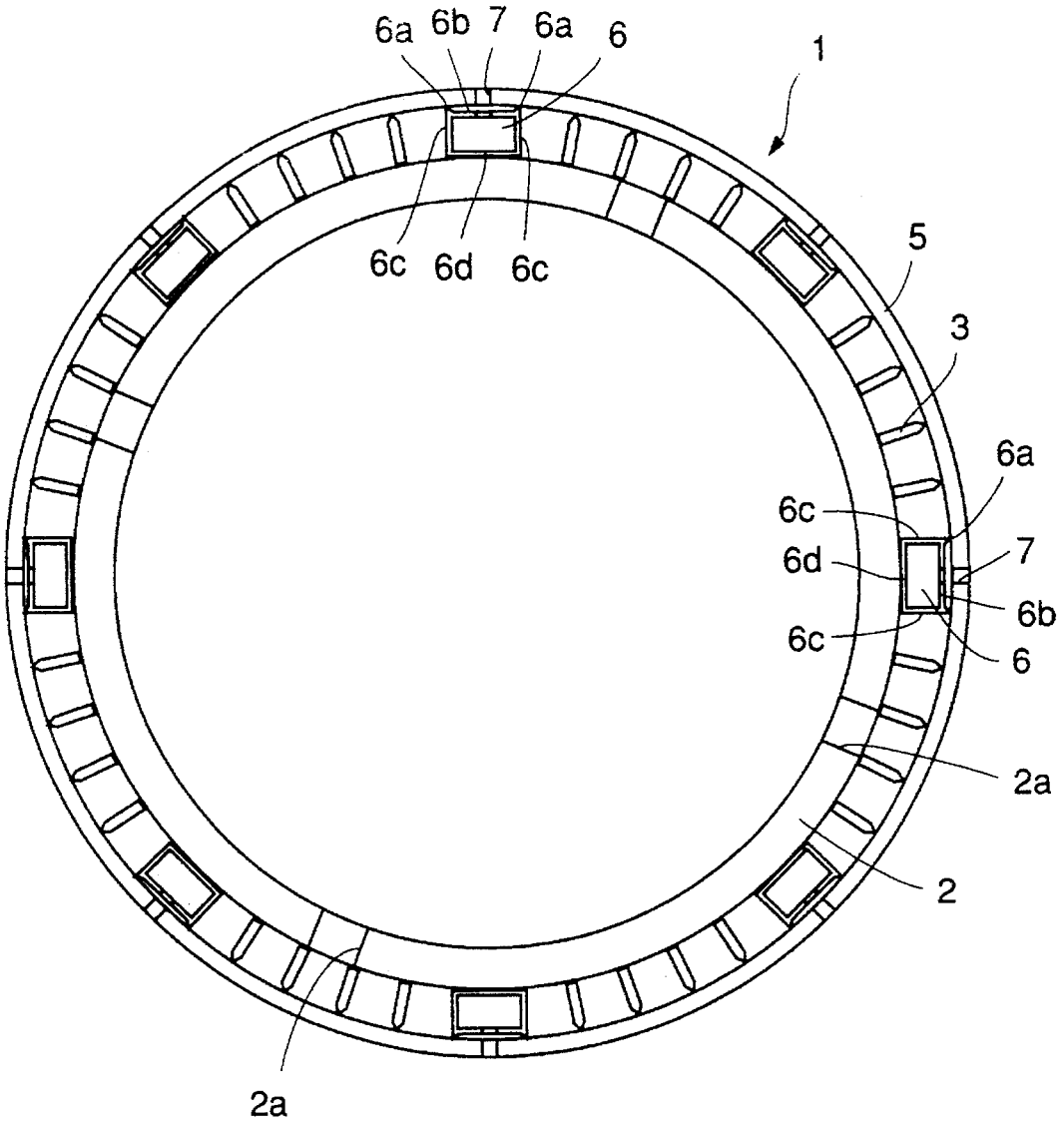
FIG. 2 is a cross sectional view of this embodiment.
Figure 3:
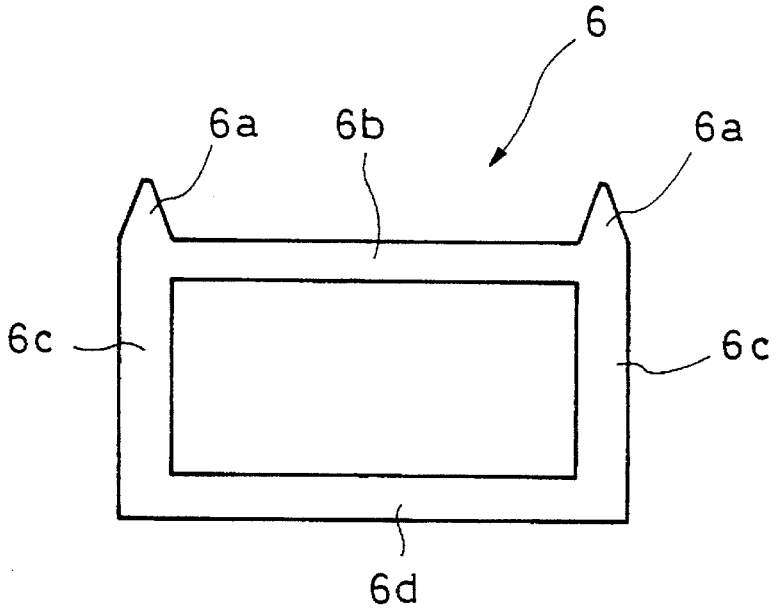
FIG. 3 is an enlarged cross sectional view of a slurry supply tube used in this embodiment.

FIGS. 1 to 4 show an embodiment of the screen made according to the invention. A screen 1 includes a pipe 2 formed with fluid intake perforations 2*a* at a predetermined interval, support rods 3 extending in the axial direction of the screen 1 disposed cylindrically at a predetermined interval in the circumferential direction of the screen 1 and a wire 5 such as a wedge wire wound on the outer periphery of the support rods so as to form slits 4 of a predetermined width. The support rods 3 are made of plate-like members which have predetermined height in the radial direction of the screen 1 and have a substantially triangular cross section. The wire 5 is welded to the support rods 3 at respective crossing points between the wire 5 and the support rods 3. The support rods 3 are disposed in a position where they do not interfere with the perforations 2*a* of the pipe 2.

In a space defined between the wire 5 and the pipe 2 of the wire 5, a plurality of (eight in the present embodiment) slurry supply Lubes 6 extending in the axial direction of the screen 1 are equidistantly provided. These slurry supply tubes 6 constitute flow paths for gravel-containing slurry. As will be apparent from the enlarged cross section of FIG. 3, each of the slurry supply tubes has a rectangular cross section and has at its end portions facing the inner periphery of the wire 5 a pair of projecting wire support portions 6*a* and 6*a* extending in the longitudinal direction of the tube. Each of the wire support portions 6*a* is formed in a triangular cross section at its end portion in the same manner as the end portion of the support rod 3 for facilitating welding with the wire 5.

In a portion of the space between the wire 5 and the pipe 2 where the slurry supply tube 6 is provided, no support rod 3 is provided but the slurry supply tube 6 functions as a flow path for supplying slurry and also as a support rod supporting the wife 5 against pressure from outside. Wire 5 is welded to the wire support portion 6*a* at the crossing point between the wire 5 and the wire support portions 6*a*. The support rods 3 and the slurry supply tubes 6 are respectively fixed to the corresponding end portions of the screen 1 by means of, e.g., welding.

In the embodiment shown in FIGS. 1 to 4, the slurry supply tube 6 has the wire support portions 6*a*, 6*a* at the two end portions of the tube 6. There may be provided another wire support portion between and in parallel to the wire support portions 6*a*, 6*a*. Alternatively, only one projecting wire supporting provided may be provided in the central portion of the top surface of the slurry supply tube 6.

In the embodiment, since the two wall portions 6*a*, 6*c* and the wire support portions 6*a*, 6*a* integrally perform a function of a support rod against the wire 5, the number of support rods can be saved by forming this slurry supply tube 6. Further, since the two wall portions 6*c*, 6*c* of the slurry supply tube 6 are connected to each other by the top plate 6*b* and the bottom plate 6*d* (see FIG. 3), these top plate 6*b* and bottom plate 6*d* function as reinforcing members in performing the function of the support rod whereby the supporting strength to support the wire 5 against the outer pressure is increased.

Figure 4:
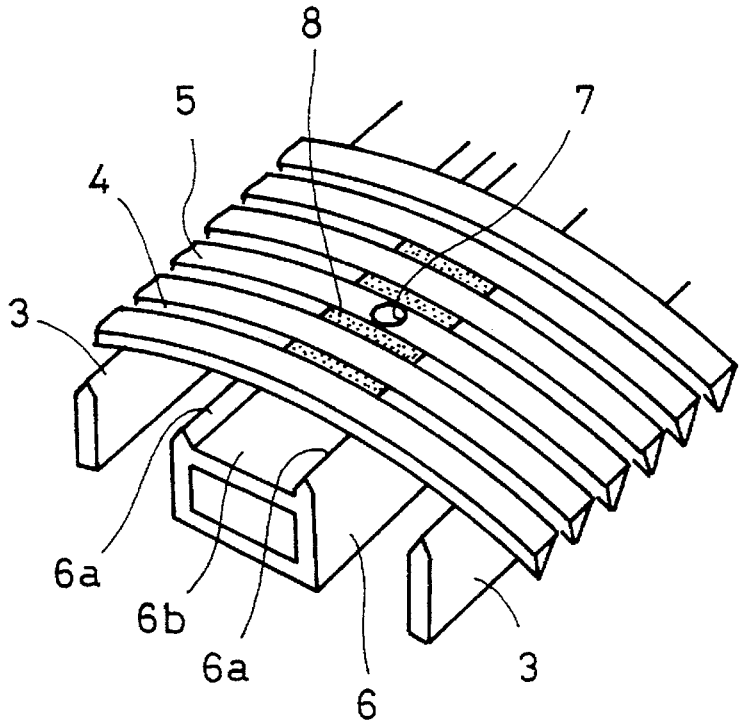
FIG. 4 is a partial perspective view showing an example of how a slurry supply hole is formed.

A slurry supply hole 7 is formed, at a predetermined interval, in the top plate 6*b* of the slurry supply tube 6 facing the wire 5 and the corresponding position of the wire 5. This slurry supply hole 7 may be formed by, for example, filling a sealant 8, as shown in FIG. 4, in a portion of the space between the wire support portions 6*a*, 6*a* above the top plate 6*b* in which the slurry supply hole 7 is to be formed and also in a corresponding portion of the slits 1 of the wire 5 and thereafter forming the slurry supply hole 7 by drilling through the wire 5, the sealant 8 and the top plate 6*b* of the slurry supply tube 6. The slurry supply holes 7 constitute the openings for communicating the flow paths of slurry with the outside of the screen.

The operation of this screen will now be described.

A plurality of the screens 1 of the above described structure are connected in a string in a manner to be described later and lowered in a wellbore (with or without a casing). This embodiment relates to a top-down type in which gravel is packed from upside toward down side and the lowermost one of the connected slurry supply tubes 6 is closed at the bottom and the uppermost one of the slurry supply tubes 6 is opened at the top and is connected to an unillustrated outside slurry supply source.

After installing the screen 1 in the wellbore, gravel-containing slurry is supplied from the outside slurry supply source to the slurry supply tubes 6 provided inside of the screen 1. The slurry is projected into the screen/wellbore annulus through the slurry supply holes 7 formed through the slurry supply tubes 6 and the wire 5 and the gravel in the slurry is settled in this annulus.

The gravel may be packed in the screen/wellbore annulus either through both the slurry supply tubes 6 and the screen/wellbore annulus or only through the slurry supply tubes 6.

Even in a case where a bridge is formed for one reason or another in the screen/wellbore annulus and the downward flow of the slurry is thereby blocked, the slurry can circumvent this bridge and continue to flow into a portion of the screen/wellbore annulus below the bridge by flowing through the slurry supply tubes 6, so that the screen/wellbore annulus can finally be packed with the gravel completely.

Figure 5:
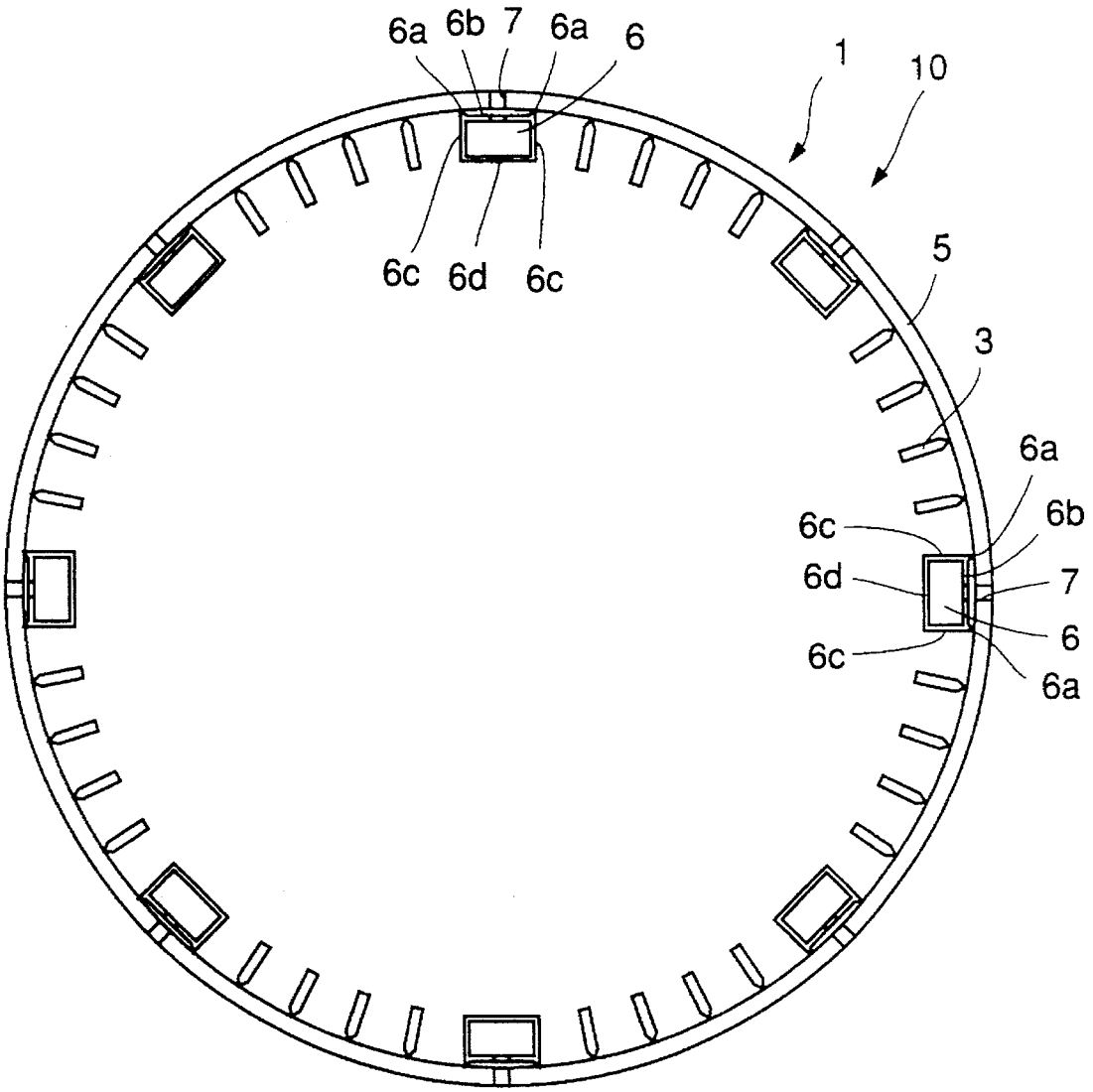
FIGS. 5 to 9 are sectional views showing other embodiments of the invention.

FIG. 5 shows another embodiment of the invention. In the description of this and subsequent embodiments, the same components as the embodiment of FIGS. 1 to 4 are designated by the same reference characters and detailed description thereof will be omitted.

The embodiment of FIG. 5 is the same in its structure and function as the embodiment of FIGS. 1 to 4 except that the screen 10 has no perforated pipe 2.

Figure 6:
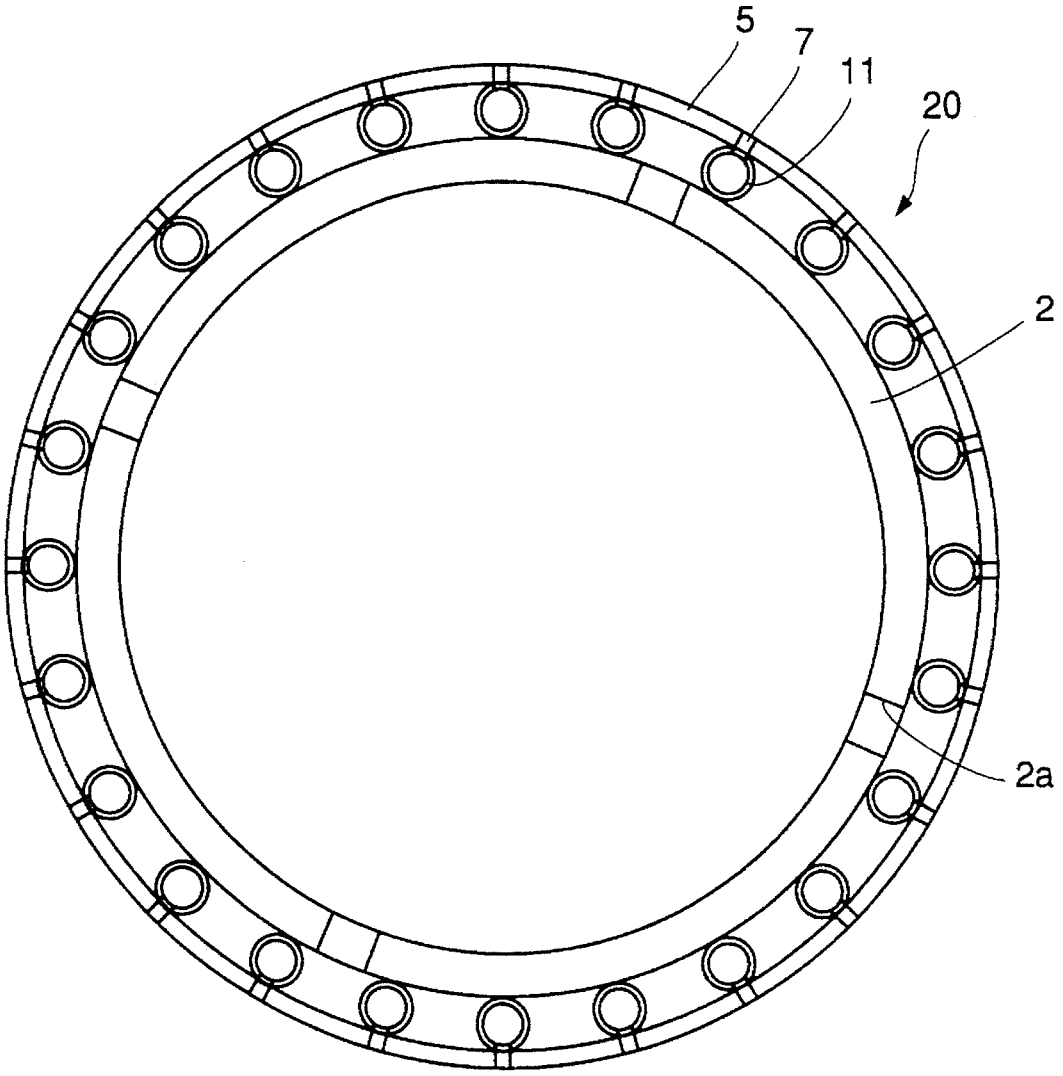

FIG. 6 shows another embodiment of the invention. In this embodiment, a screen 20 has no support rods 3 as in the above described embodiments but cylindrical slurry supply tubes 11 only function as the support members supporting the wire 5 against the outer pressure. The respective slurry supply tubes 11 are fixed at their end portions the screen 20 by welding or the like.

In this embodiment, the slurry supply tubes 11 function as the support members so that the support rods can be omitted.

Figure 7:
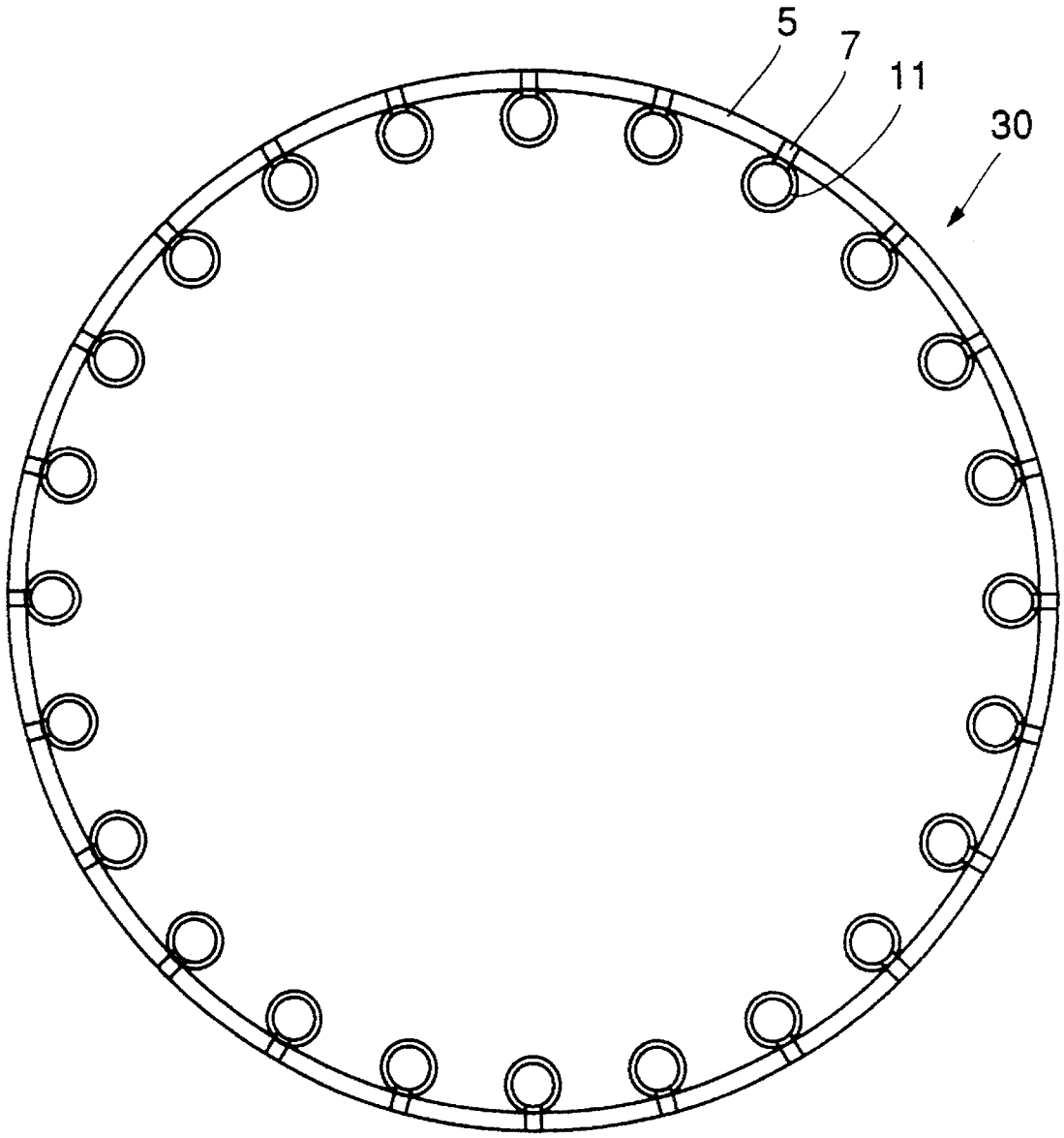

FIG. 7 shows another embodiment of the invention. The embodiment is the same in the structure and function as the embodiment of FIG. 6 except that the screen 30 has no perforated pipe 2.

Figure 8:
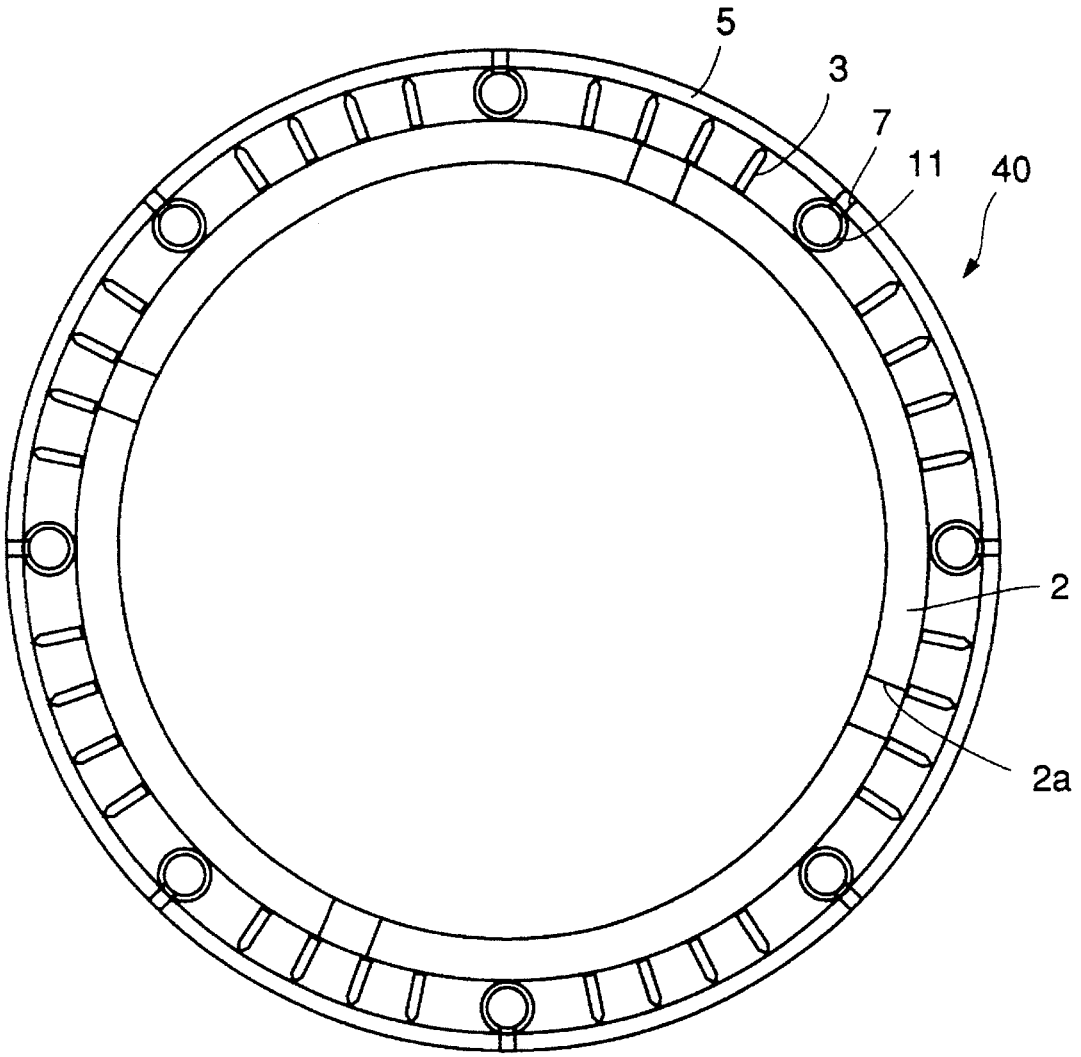

FIG. 8 shows another embodiment of the invention. In this embodiment, a screen 40 has, as the embodiment of FIG. 6, cylindrical slurry supply tubes 11 but, different from the embodiment of FIG. 6, the slurry supply tubes 11 (eight in this embodiment) are provided at interval and support rods 3 are provided between the slurry supply tubes 11. The other structure is the same as the embodiment of FIG. 6.

Figure 9:
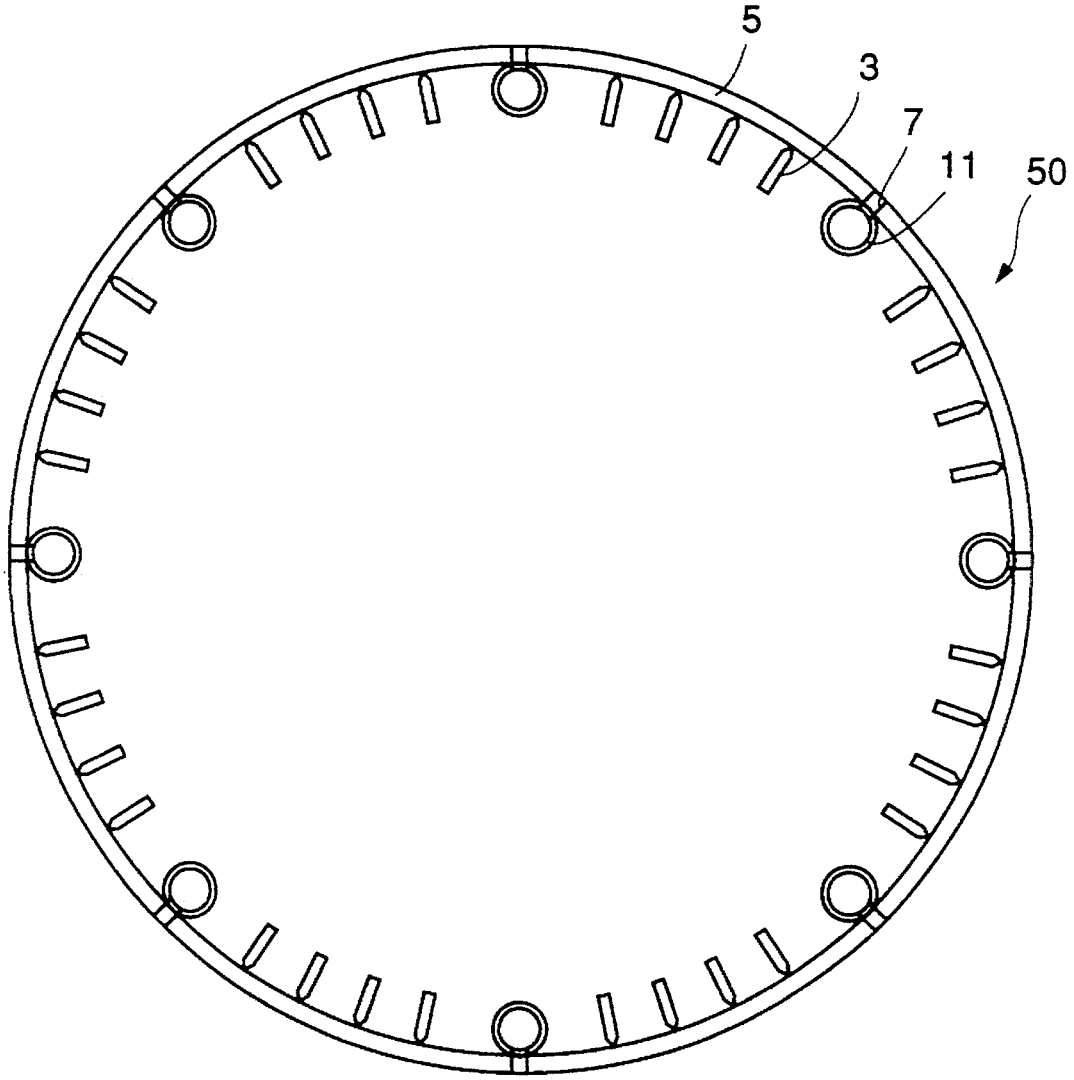

FIG. 9 shows another embodiment of the invention. This embodiment is the same in the structure and function as the embodiment of FIG. 8 except that a screen 50 has no perforated pipe 2.

Figure 10:
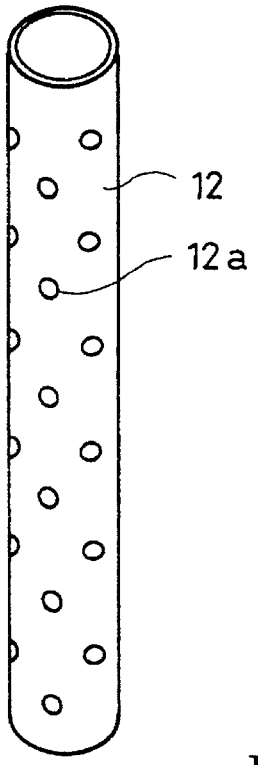
FIG. 10 is a perspective view showing another example of the slurry supply tube.

In the above described embodiments, the slurry supply tubes can be replaced by a cylindrical slurry supply tube 12 as shown in FIG. 10 which has fluid intake slits 12*a* formed at a predetermined interval. Alternatively, as shown in FIG. 11, the slurry supply tube may be constructed of a small cylindrical screen 15 which includes a plurality of support rods 13 disposed cylindrically in the circumferential direction of the screen at a predetermined interval and extending in the axial direction of the screen, and a wire 15 wound on the outer periphery of the support rods 13 so as to form slits 16 of a predetermined width.

Figure 11:
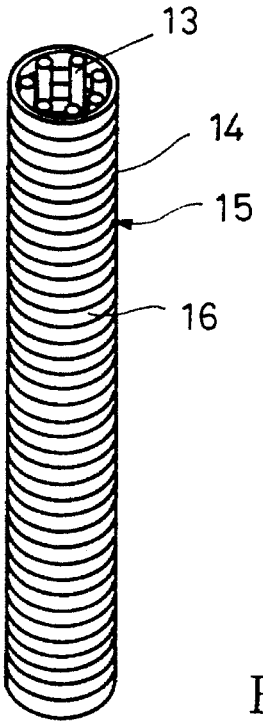
FIG. 11 is a perspective view showing another example of the slurry supply tube.

In case the slurry supply tubes 12 and 15 of FIGS. 10 and 11 are used, the fluid intake slits 12*a* and 16 must be determined to a size at which gravel in slurry does not flow out of the slits 12*a* or 16. The slurry supply tubes 12 and 15 not only supply gravel-containing slurry from the slurry supply holes 7 but, after completing supply of the slurry, receives fluid such as oil or gas into the inside of the screen through the fluid intake slits 12*a* of the slurry supply tube 12 or the screen slits 15 of the slurry supply tube 15 with resulting increase in the fluid receiving capacity of the screen.

Figure 12:
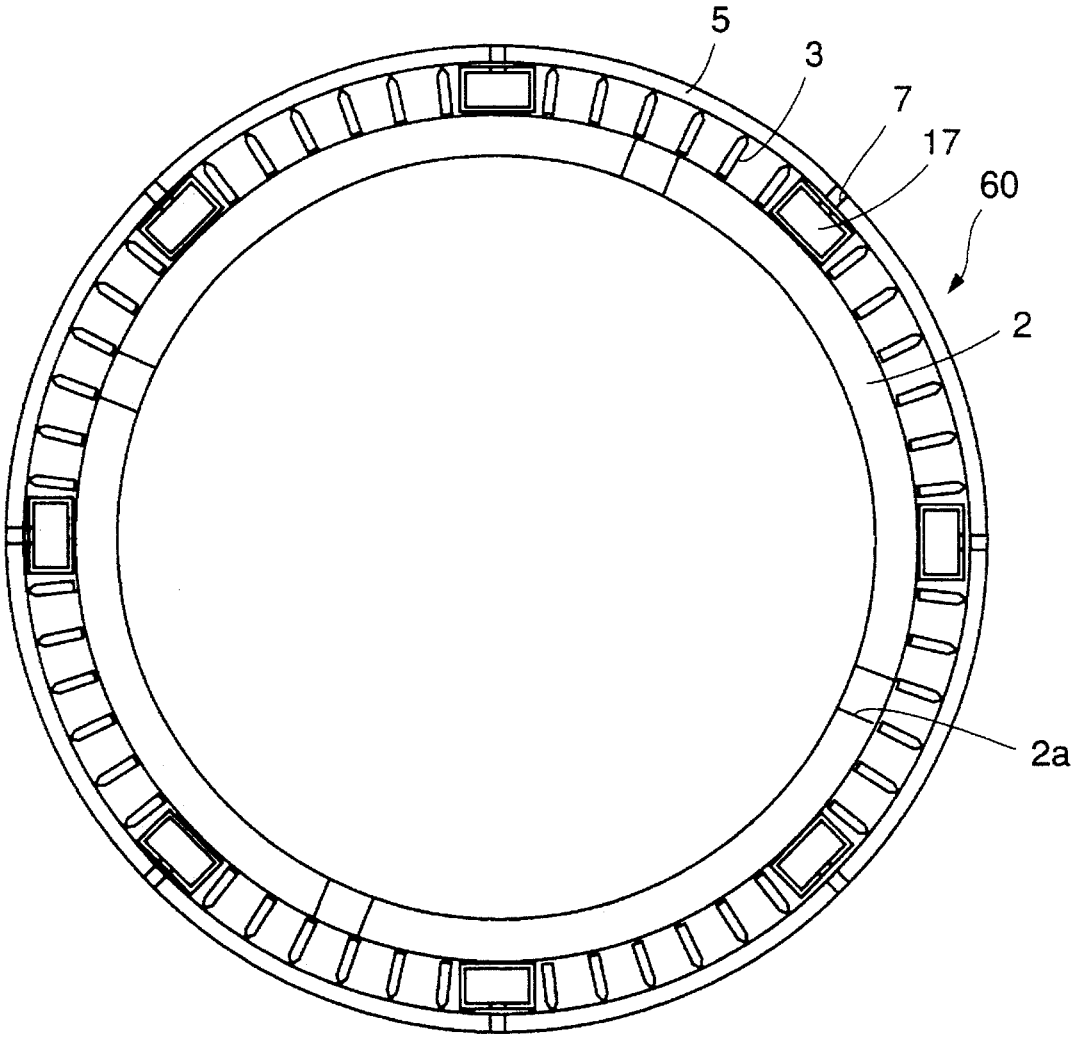
FIGS. 12 to 18 are cross sectional views showing other embodiments of the invention.

FIG. 12 shows another embodiment of the invention. In this embodiment, the screen 60 includes slurry supply tubes 17 of a rectangular cross section which are inserted at a predetermined interval between support rods 3. Different from the above described embodiments, the slurry supply tubes 17 do not perform the function of the support members supporting the wire 5 against the outer pressure.

Figure 13:
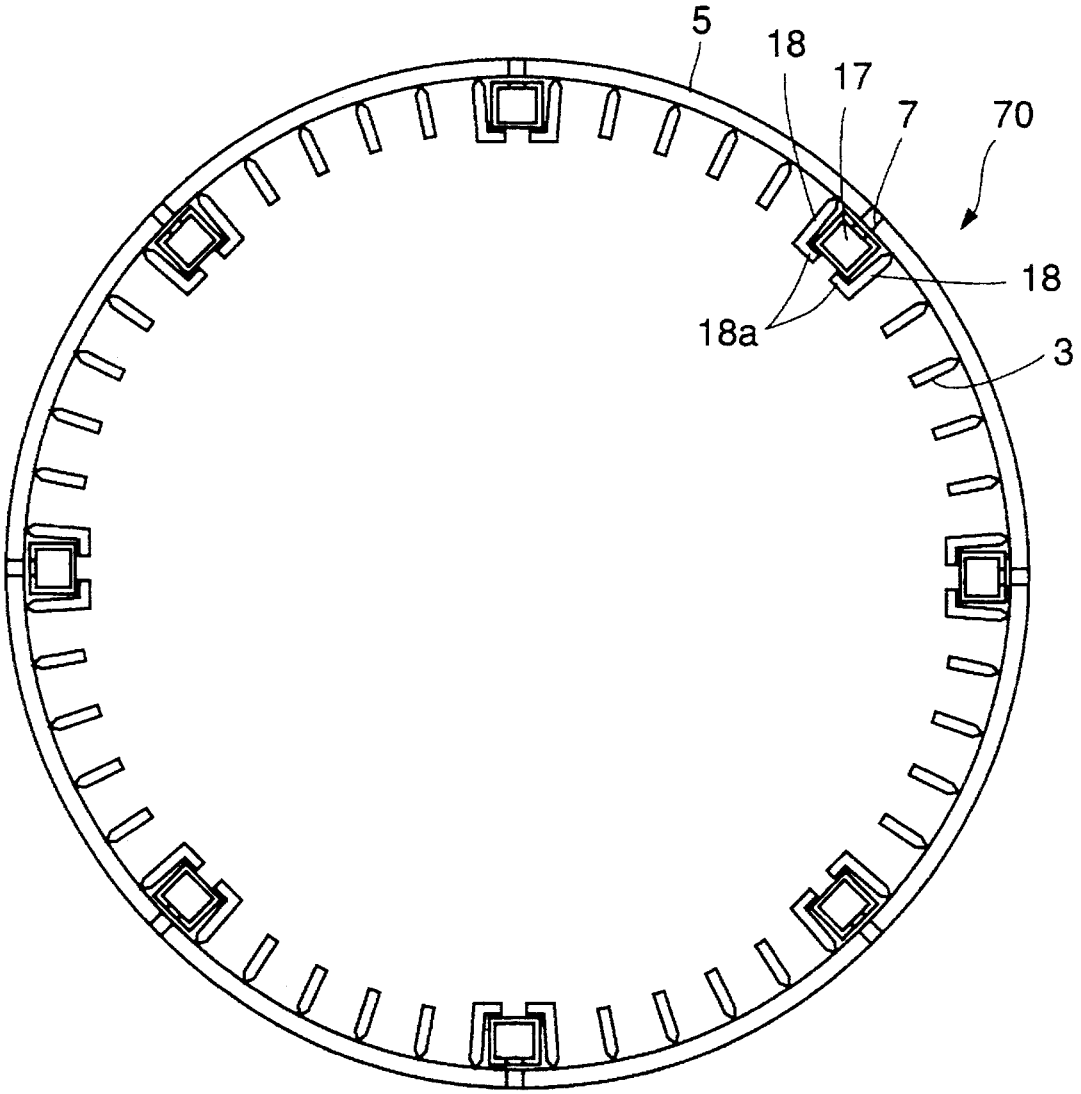

FIG. 13 shows another embodiment of the invention. In this embodiment, a screen 70 has, as the screen 60 of the embodiment of FIG. 12, slurry supply tubes 17 which have no function of the supporting members. The screen 70 however has no perforated pipe 2. Support rods 18 on two sides of each slurry supply tube 17 are bent in the shape of L in a direction in which they approach each other to form flanges 18*a* and thereby support the slurry supply tube 17.

Figure 14:
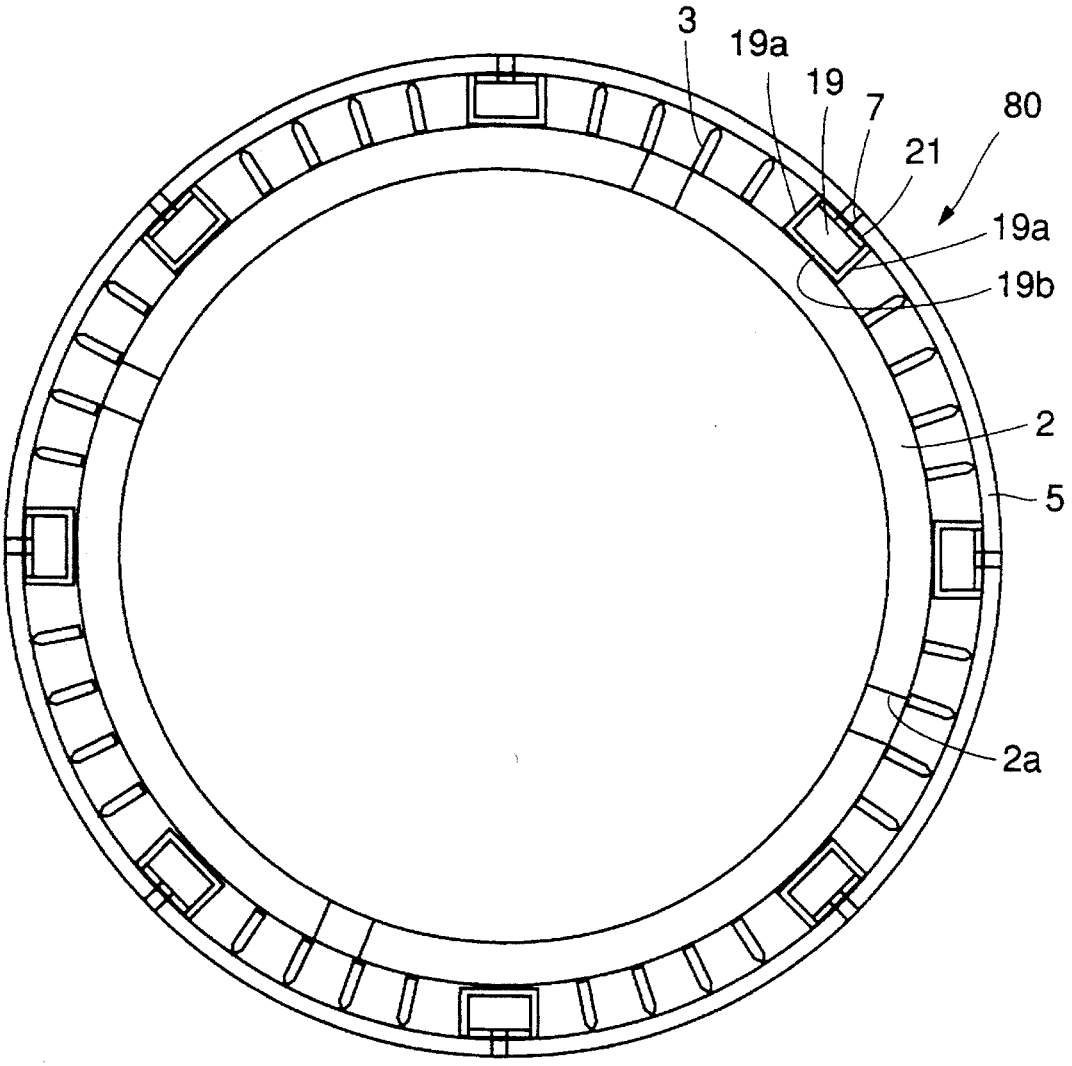

FIG. 14 shows another embodiment of the invention.

In this embodiment, flow paths of slurry in a screen 80 are formed by channel-like members 19 (eight in this embodiments which are disposed equidistantly in the circumferential direction and extending in the axial direction of the screen 80 and plates or sealant 21 which close the opened portions of these channel-like members 19. Each of the channel-like members 19 is formed by walls 19*a*, 19*a* and a connecting portion 19*b* which connects the walls 19*a*, 19*a*. The two walls 19*a* function as support members supporting the wire 5 against the outside pressure.

This embodiment has, as the embodiment of FIGS. 1 to 4, the advantage of omitting the number of the support rods. Besides, the connecting portion 19*b* connecting the walls 19*a*, 19*a* functions as a reinforcing member which increases the wire supporting strength against the outside pressure.

Figure 15:
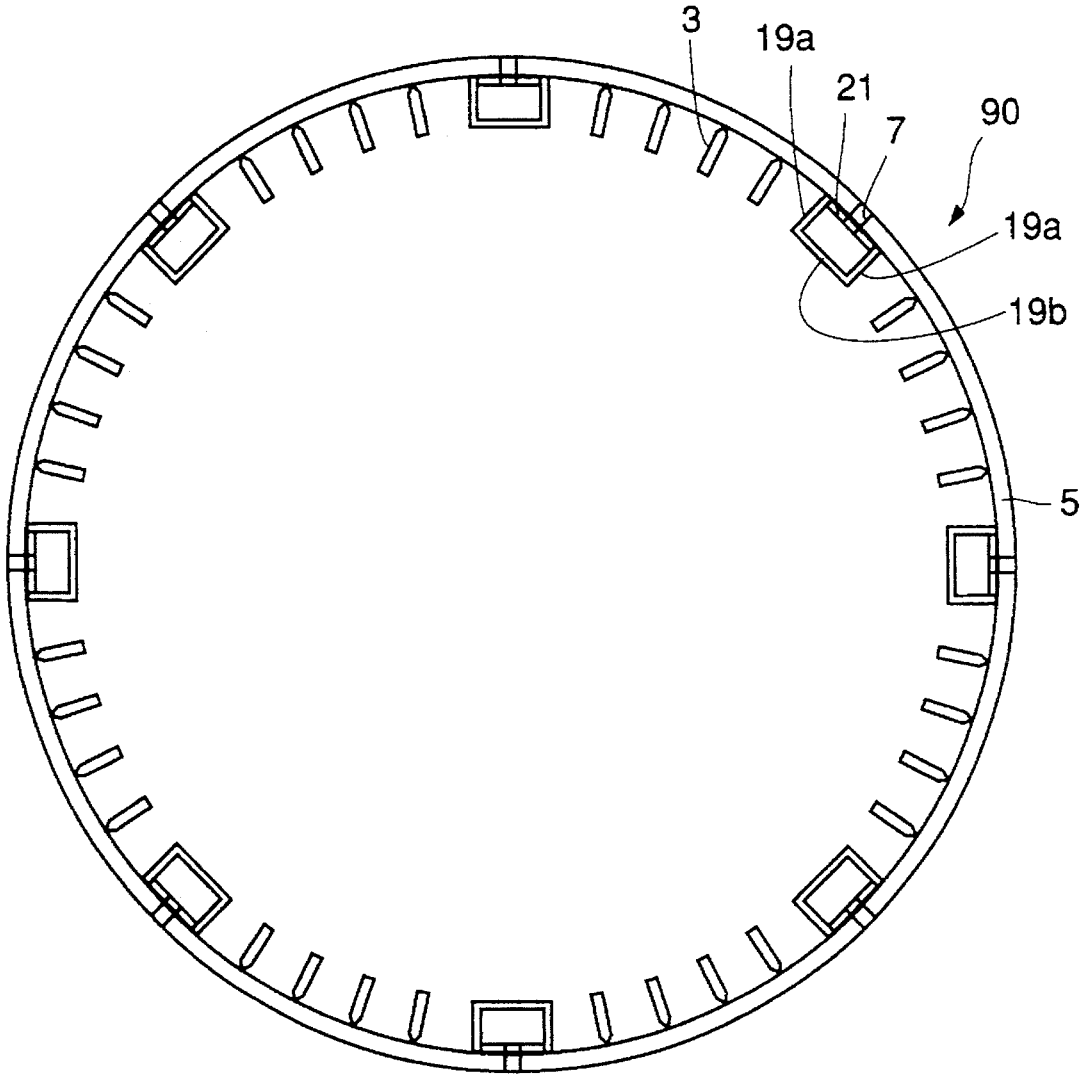

FIG. 15 shows another embodiment of the invention. In this embodiment, a screen 90 is the same in the structure and function as the embodiment of FIG. 14 except that the screen 90 has no perforated pipe 2.

Figure 16:
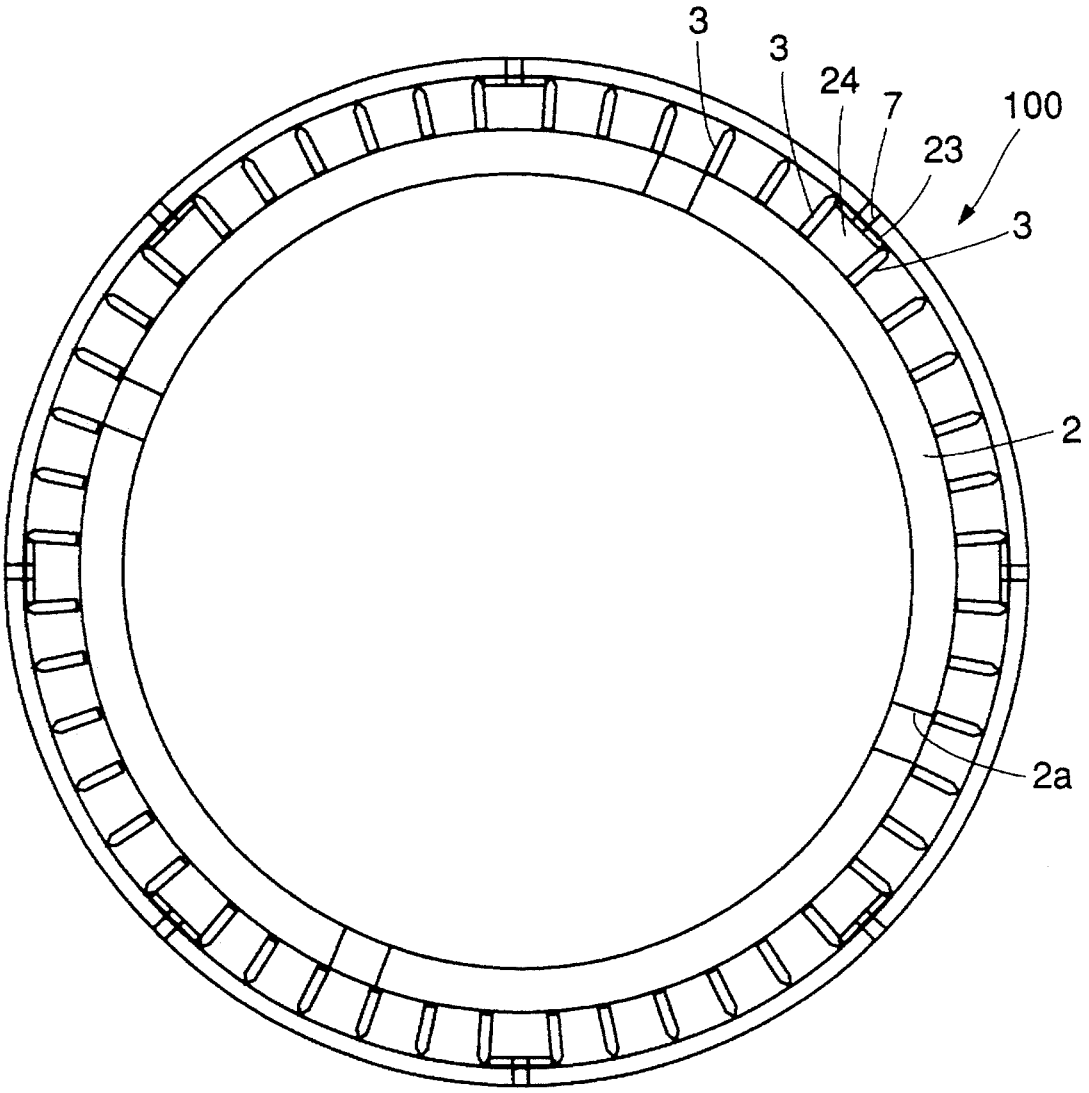

FIG. 16 shows another embodiment of the invention. In this embodiment, a flow path 24 of slurry in a screen 100 is formed by two adjacent one of the plate-like support rods 3 disposed on the outer periphery of the pipe 2 and having a cross section extending in the radial direction of the pipe 2, the outer peripheral surface of the pipe 2 between the two plate-like support rods 3 and a plate or sealant 23 provided in a space between the two plate-like support rods 3 and adjacent to the inner periphery of the wire 5.

In this embodiment, since the outer peripheral surface of the pipe 2 and the support rods 3 are utilized as a part of the members constituting the flow path for slurry, the member particularly required for forming a flow path is the plate or sealant 23 only, so that material can be saved and the screen structure can be simplified and the weight of the screen can be held at the minimum.

Figure 17:
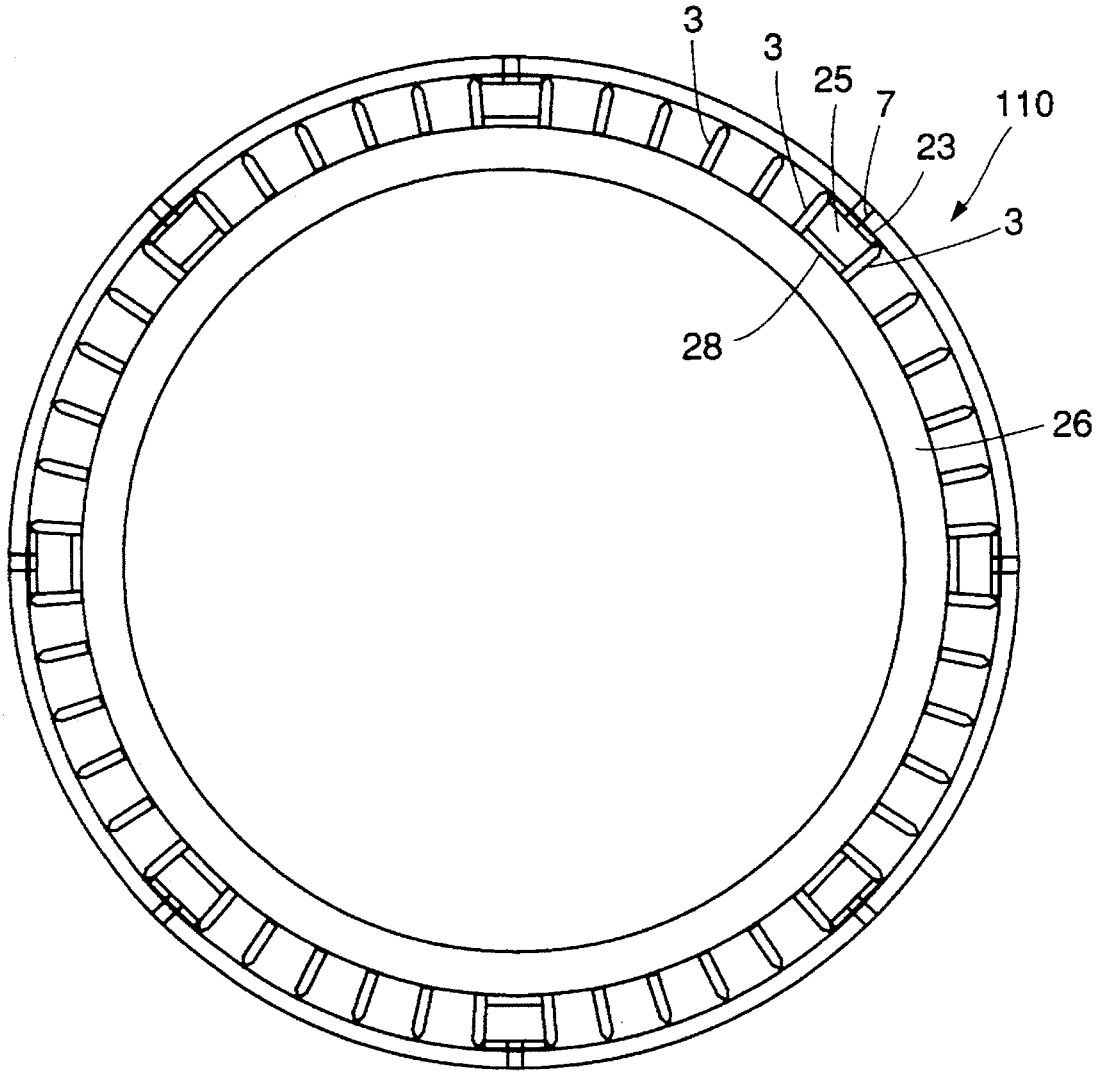

FIG. 17 shows another embodiment of the invention. In this embodiment, a screen 110 includes a plurality of rings 26 provided at a predetermined interval in the axial direction of the screen instead of the perforated pipe 2. A flow path 25 for slurry is formed by two adjacent plate-like support rods 3, 3 having a cross section extending in the radial direction, a plate or sealant 23 provided in a space between the two support rods 3, 3 adjacent to the inner periphery of the wire 5, and a plate 28 provided adjacent to the outer periphery of the rings 26.

Figure 18:
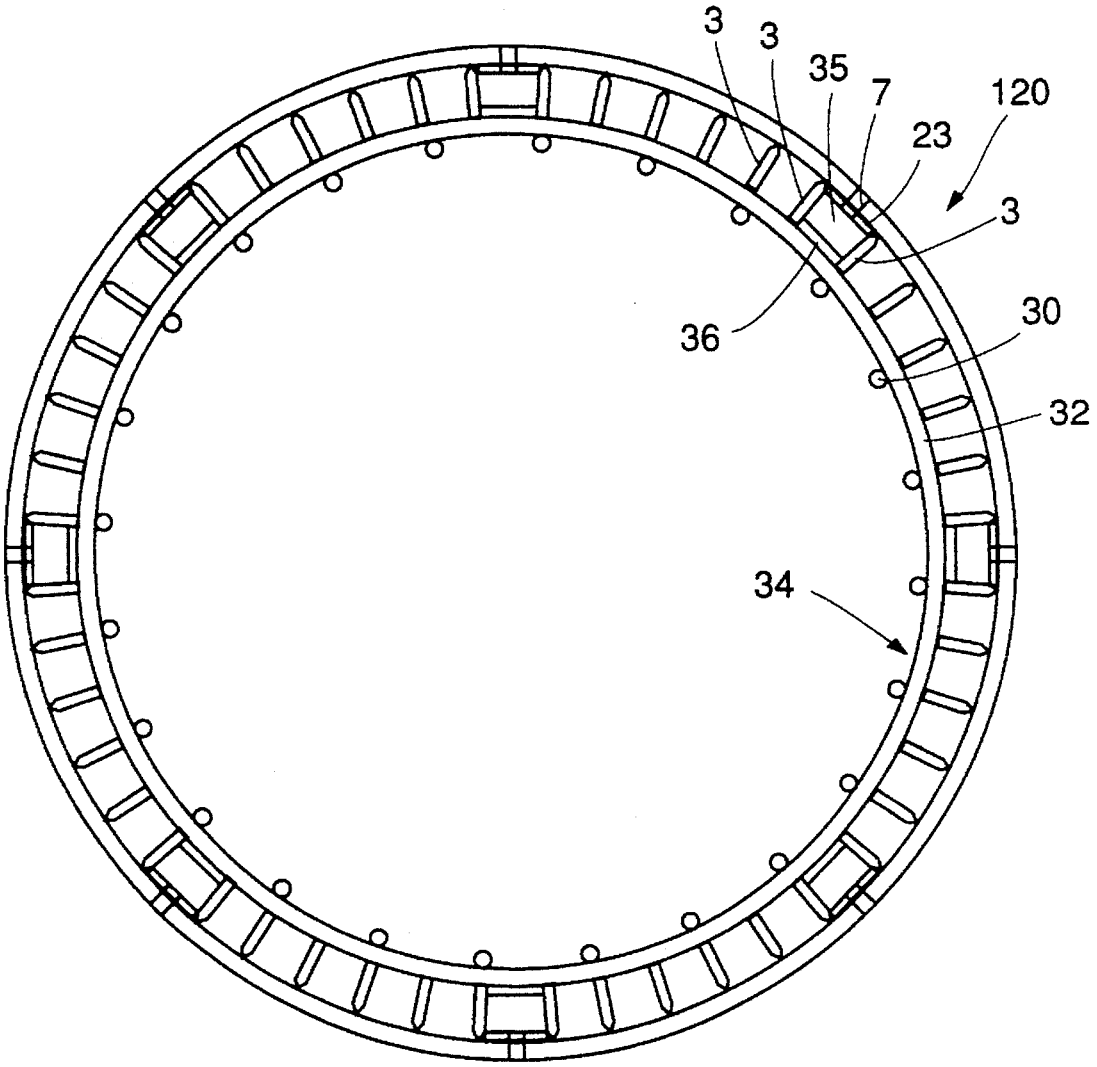

FIG. 18 shows another embodiment of the invention.

In this embodiment, a screen 120 has, instead of the perforated pipe 2 of the embodiment of FIG. 16, an inner cylindrical screen 34 including a plurality of support rods 30 disposed in the circumferential direction at a predetermined interval and extending in the axial direction of the screen and a wire 32 wound on the outer periphery of the support rods 30 so as to form slits of a predetermined width. Support rods 3 are plate-like members disposed on the outer periphery of the inner screen 34 and each of the flow paths for slurry is formed by two adjacent ones of the plate-like support rods 3 adjacent to the outer periphery of the inner sealant 34, a plate or sealant 23 provided in a space between the two support rods 3, 3 adjacent to the inner periphery of the wire 5, and a plate 36 provided adjacent to the outer periphery of the inner screen 34.

Figure 19:
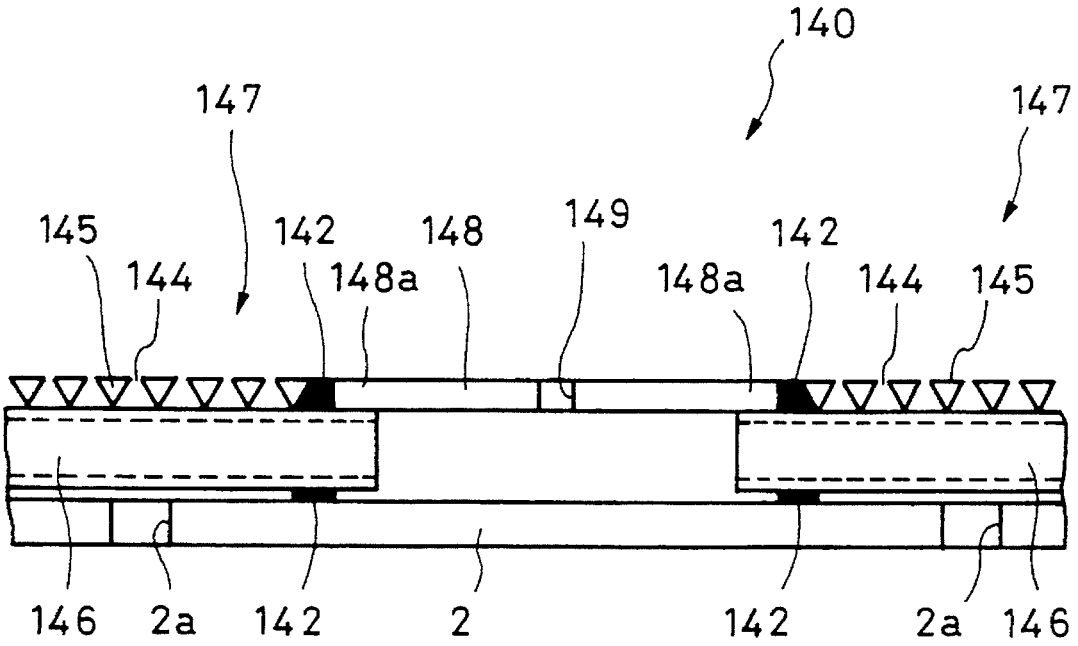
FIG. 19 is a partial sectional view showing an embodiment in which the invention is applied to a selective isolation screen.

FIG. 19 shows another embodiment of the invention in which the invention is applied to a selective isolation screen.

A selective isolation screen is a screen which is disclosed, e.g., by U.S. Pat. No. 4,771,829. This screen includes a generally cylindrical base member having plural openings (e.g., a perforated pipe), support members provided on the outer periphery of this base member at an interval in the circumferential direction of the base member and extending in the axial direction, and a wire wound on the outer periphery of the support members to form slits of a predetermined width, an annulus divided by the support members and extending in the axial direction being formed between the inner periphery of the wife and the outer periphery of the base member about the entire circumference of the base member, and the screen further includes seal means provided at a selected position in the axial direction of the screen for isolating and sealing the annulus dividing by the support members and extending in the axial direction. According to this arrangement, when, in carrying out removal of blocking of the screen or packing of gravel, fluid is injected radially outwardly from the inside of the base member in a screen section corresponding to a site where blocking of the screen has occurred or packing of gravel is to be achieved, the injected fluid which is restricted its vertical movement in the annulus by the seal means provided above and below the screen section is injected radially toward the wellbore through the slits of the wire as desired so that removal of blocking and packing of gravel can be achieved effectively.

In this embodiment, a selective isolation screen 140 is composed of screen jackets 147 fitted and welded on the outer periphery of the pipe 2 having perforations 2*a* and extending in the axial direction of the screen. Each of the screen jackets 147 includes a plurality of support rods (not shown) disposed in the circumferential direction at an interval and extending in the axial direction of the screen, a wire 145 wound on the outer periphery of the support rods so as to form slits of a predetermined width, and flow paths for slurry provided inside of the wire 145. A cylindrical cover plate 148 connecting the end portions of the adjacent screen jackets 147 is provided. The seal means is formed by welding the end portions 148*a* of the cover plate 148 and the end portions of the screen jackets 147 to the pipe 2 about the entire circumference of the pipe 2. A slurry supply opening 149 is formed in the cover plate 148.

In case the present invention is applied to the selective isolation screen, the base member is not limited to the perforated pipe shown in FIG. 19 but a spiral wire extending in the axial direction of the screen may be used. Alternatively, a plurality of rings may be provided in parallel at an interval in the axial direction of the screen to form slits. As the base member, a cylindrical member made by a plurality of rods disposed cylindrically at a predetermined interval and a spiral wire wound on the outer periphery of the rods with a predetermined pitch, with the wife and rods being welded together, may also be used.

This invention is applicable also to a pre-packed screen in which gravel is previously packed in an annulus defined between the perforated pipe 2 or the outer peripheral surface of the inner screen 34 and the inner periphery of the wire 5 in the screen having the perforated pipe 2 as in the embodiment of FIGS. 1, 6, 8, 12, 14 or 16 or in the screen having the inner screen as in the embodiment of FIG. 18.

In one aspect of the invention, a slitted pipe having a multiplicity of slits formed in the axial direction is used instead of the wire 5 of the embodiments of FIG. 6 or FIG. 7. In this case, the cylindrical slurry supply tubes 11 do not function as the wire supporting rods but simply function as a spacer between the perforated pipe 2 and the slitted pipe. Other structure and function are the same as those embodiments shown in FIGS. 6 and 7. The slurry supply tubes 11 need not be of a cylindrical shape but may be selected from among those having various shapes and constructions such as square or polygonal tubes or those shown in FIGS. 10 and 11. In the case where a perforated tube is used in the screen, gravel may be packed in the annulus between the respective slurry supply tubes. The structure of this embodiment may also be applied to the selective isolation screen.

Description will now be made about the manner of connecting the well screens and installing the connected screens to the wellbore.

Figure 20:
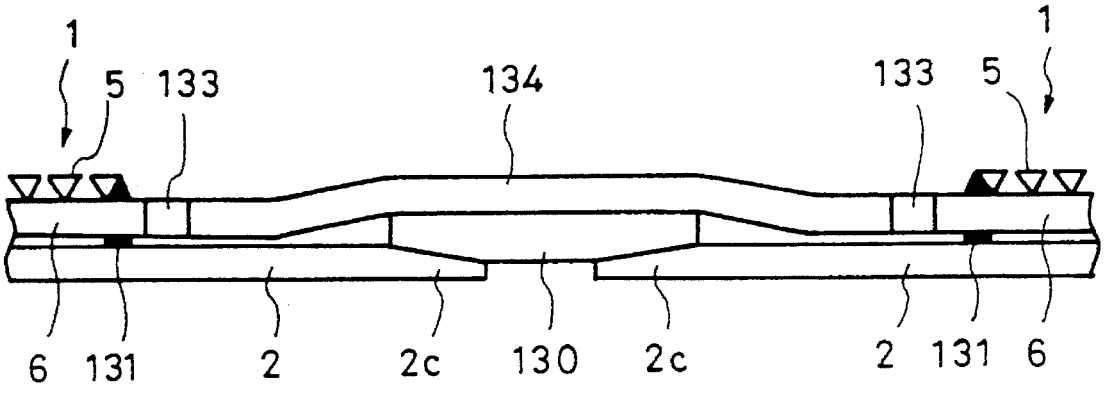
FIGS. 20 to 22 are partial sectional views showing examples of connection of two adjacent screens.

In FIG. 20, connecting ends 2*c*, 2*c* of pipes 2, 2 of adjacent screens 1, 1 are threaded and are connection with each other by means of a coupling 130 which is threaded at ends thereof to be threadedly engage the end portions 2*c*, 2*c*. The end portions of slurry supply tubes 6, 6 of the screens 1, 1 are welded annularly to the perforated pipe 2 to form annular seal sections 131, 131. The slurry supply tubes 6, 6 are connected to a connecting tube 134 through joints 133, 133 and the two slurry supply tubes 6, 6 communicate with each other.

Figure 21:
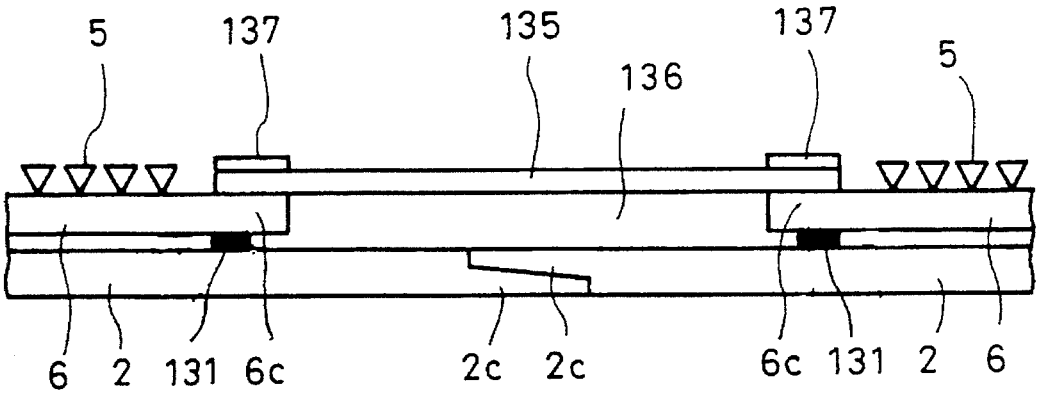

FIG. 21 shows another example of connection of the screens 1, 1. In FIG. 21, the end portions 2*c*, 2*c* of pipes 2, 2 of screens 1, 1 are threaded and are in threaded engagement with each other and the perforated pipes 2, 2 have the outer peripheral surfaces which are flush with each other. The end portions of the slurry supply tubes 6, 6 are welded annularly on the perforated pipe 2 to form annular seal sections 131, 131. A cylindrical cover plate 135 is provided between the slurry supply tubes 6, 6 in a manner to cover the end portions of the slurry supply tubes 6, 6. The end portions of the cover plate 135 are fixed to the end portions 6*c*, 6*c* of the slurry supply tubes 6, 6 by means of steel band 137, 137. An annulus 136 between the inner peripheral surface of the cover plate 135 and the outer peripheral surface of the connected pipes 2, 2 constitutes an annular space which communicates the slurry supply tubes 6, 6 with each other.

Figure 22:
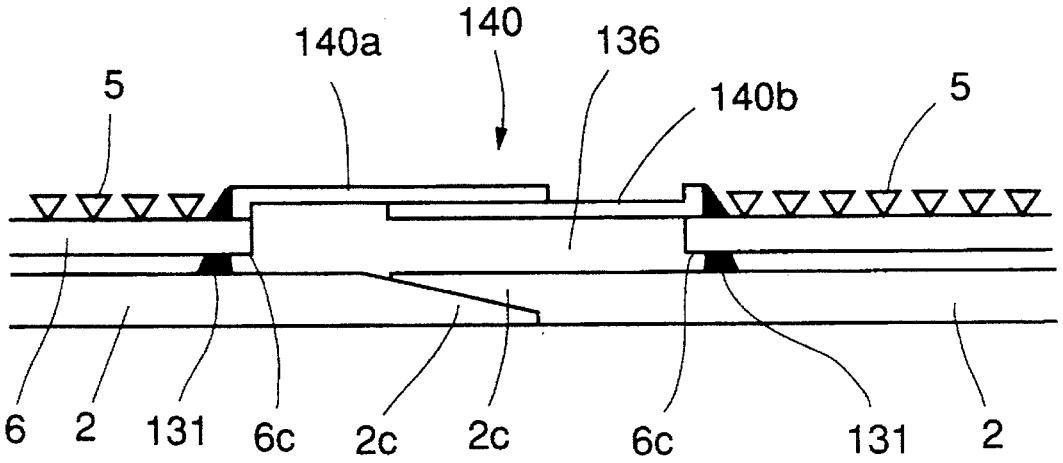

FIG. 22 shows still another example of connection of screens 1, 1.

In FIG. 22, the same components as those of FIG. 21 are designated by the same reference characters and description thereof will be omitted. The manner of connection shown in FIG. 22 resembles that shown in FIG. 21 but, different from that shown in FIG. 21, a cylindrical cover plate 140 consists of a cover plate portion 140*a* which is welded to one slurry supply tube 6 and a cover plate portion 140*b* which is welded to the other slurry supply tube 6. The cover plate portion 140*b* is inserted and fitted telescopically inside of the cover plate portion 140*a*. Accordingly, as the end portions 2*c*, 2*c* are rotated and threadedly engaged with each other, the outer peripheral surface of the tip portion of the cover plate portion 140*b* rotatingly slides against the inner peripheral surface of the cover plate portion 140*a* to form the cover plate 140. According to this method, each cover plate portion can be welded in a factory so that welding work at a screen installation site becomes unnecessary and this is quite beneficial in the installation work.

In the manner of connection shown in FIGS. 21 and 22, a circumferential space between the respective slurry supply tubes is also sealed by welding material so that the annular space 136 is entirely sealed from outside.

What is claimed is:

1. A well screen having a slurry flow path enclosed therein comprising:

a plurality of support members extending in an axial direction and disposed in cylindrical fashion at a predetermined interval from each other in a circumferential direction;

wire means wound around said support members so as to form slits of a predetermined width said wire means and said support members forming a generally tubular structure;

one or more flow paths for gravel-containing slurry provided inside of said wire means and extending in the axial direction said flow paths being isolated from the interior of said tubular structure; and a plurality of openings for allowing the gravel-containing slurry to flow outside of said wire means so that said flow paths are in fluid communication with the interior of said tubular structure only through said slits.

2. A well screen as defined in claim 1 wherein at least a part of said plurality of support members form tubes which constitute said flow paths for slurry.

3. A well screen as defined in claim 2 wherein said support members which form tubes have at least one projecting wire supporting portion extending in the axial direction of the support members and disposed on a radially-outward facing surface of the support members.

4. A well screen as defined in claim 2 wherein said support members which form tubes have a plurality of slits formed at a predetermined interval.

5. A well screen as defined in claim 1 wherein at least a part of said plurality of support members comprises smaller cylindrical screens each of which includes:

a plurality of support rods disposed cylindrically in the circumferential direction of the screen at a predetermined interval and extending in the axial direction of the screen; and wire means wound on the outer periphery of said support rods so as to form slits of a predetermined width, said smaller cylindrical screens forming said flow paths for slurry.

6. A well screen as defined in claim 1 wherein at least a part of said plurality of support members are channel-like members, said flow paths for slurry are formed by sealing opened portions of the channel-like members and forming said plurality of openings through said sealed portions.

7. A well screen as defined in claim 1 wherein said flow paths are tubes which are provided between two adjacent ones of said plurality of support members.

8. A well screen as defined in claim 1 which further comprises a pipe having perforations formed at a predetermined interval and wherein said support member are plate-like support rods disposed on the outer periphery of said pipe and extending in the radial direction of the pipe, and each of said flow paths for slurry is formed by two adjacent ones of the plate-like support rods, the outer peripheral surface of said pipe between said two plate-like support rods and a plate provided in a space between the two plate-like support rods and adjacent to the inner periphery of said wire means.

9. A well screen as defined in claim 1 which further comprises a plurality of rings provided at a predetermined interval in the axial direction of the screen and wherein said plurality of support member are plate-like support rods disposed at the outer periphery of said rings and extending in the radial direction and each of said flow paths for slurry is formed by two adjacent ones of said plate-like support rods, a plate provided in a space between the two plate-like support rods adjacent to the inner periphery of said wire means and a plate in this space adjacent to the inner periphery of said wire means.

10. A well screen as defined in claim 1 which further comprises an inner cylindrical screen comprising a plurality of support rods disposed in the circumferential direction at a predetermined interval and extending in the axial direction of the screen and a wire wound on the outer periphery of said support rods so as to form slits of a predetermined width and wherein said plurality of support members are plate-like support rods disposed on the outer periphery of said inner screen and each of said flow paths for slurry is formed by two adjacent ones of the plate-like support rods, a plate provided in a space between the two adjacent plate-like support rods adjacent to the outer periphery of said inner screen and a plate provided in this space adjacent to the inner periphery of said wire means.

11. A well screen as defined in claim 1 which further comprises a pipe having perforations formed at a predetermined interval and is constructed as a prepacked screen in which gravel is filled in a space defined between the outer periphery of said pipe and the inner periphery of said wire means.

12. A well screen as defined in claim 1 which further comprises an inner cylindrical screen comprising a plurality of support rods disposed in the circumferential direction at a predetermined interval and extending in the axial direction of the screen and wire means wound on the outer periphery of the support rods so as to form slits of a predetermined width and wherein said screen is constructed as a prepacked screen in which gravel is filled in a space defined by the outer periphery of said inner screen and the inner periphery of said wire means.

13. A well screen as defined in claim 1 which further comprises a pipe having perforations formed at a predetermined interval and wherein said support members are disposed on the outer periphery of said pipe, said pipe is connected with said pipe of an adjacent well screen which is of the same construction as said screen in such a manner that the outer surfaces of the two adjacent pipes become flush with each other, a cylindrical cover plate is provided between the end portions of the two adjacent screens and the space between the inner periphery of said cover plate and the outer periphery of said pipes functions as a space for communicating the flow paths for slurry of the two screens with each other.

14. A well screen as defined in claim 13 wherein said cover plate consists of a first cover plate portion one end of which is fixed to the end portion of one of the two screens and a second cover plate portion one end of which is fixed to the end portion of the other screen, said second cover plate portion being fitted telescopically inside of the first cover plate portion.

15. A well screen having a slurry flow path enclosed therein comprising:

a generally cylindrical base member having perforations;

a plurality of support members disposed on the outer periphery of said base member at a predetermined interval in the circumferential direction and extending in the longitudinal direction of the base member;

wire means wound on the outer periphery of said support members so as to provide slits of a predetermined width;

a portion of an annulus defined by the inner side of said wire means, the outer periphery of said base member and two adjacent ones of said supporting members;

seal means provided at a selected position and interval in the axial direction of the screen for isolating and sealing said annulus portion;

one or more isolated flow paths for slurry provided between the inner periphery of said wire means and the outer periphery of said base member and extending in the axial direction of the screen; and openings provided in said seal means for communicating said flow paths with the outside of the screen.

16. A well screen as defined in claim 11 wherein said screen is composed of screen jackets fitted and welded on the outer periphery of the base member, each of said screen jackets comprising:

a plurality of support members disposed in the circumferential direction at an interval and extending in the axial direction of the screen;

wire means wound on the outer periphery of said support members so as to form slits of a predetermined width; and flow paths for slurry provided inside of said wire means, and said screen further comprises a cylindrical cover plate connecting the end portions of adjacent screen jackets.

17. A well screen comprising:

a slitted pipe formed with a multiplicity of slits;

one or more tubular flow paths for gravel-containing slurry provided on the inner periphery of said slitted pipe and extending in the axial direction of the screen said flow paths being isolated from direct fluid communication with the interior of said slitted pipe; and openings for communicating said flow paths with the outside of said slitted pipe.

* * * * *